US006293393B1

(12) United States Patent
Clay

(10) Patent No.: US 6,293,393 B1
(45) Date of Patent: Sep. 25, 2001

(54) APPARATUS AND METHODS FOR PACKAGING AND DISTRIBUTING COMBINATIONS OF FOODS AND BEVERAGES

(75) Inventor: Forrest Kelly Clay, Worland, WY (US)

(73) Assignee: SDK Co., Inc., Worland, WY (US)

( * ) Notice: Subject to any disclaimer, the term of this patent is extended or adjusted under 35 U.S.C. 154(b) by 0 days.

(21) Appl. No.: 09/618,194

(22) Filed: Jul. 18, 2000

(51) Int. Cl.[7] ..... B65D 85/00

(52) U.S. Cl. ..... 206/217; 53/171; 53/445; 206/216; 206/541

(58) Field of Search ..... 53/48.2, 48.3, 53/171, 397, 398, 441, 442, 445, 449; 206/139, 140, 216–218, 427, 434, 497, 541, 545, 549

(56) References Cited

U.S. PATENT DOCUMENTS

| | | | | |
|---|---|---|---|---|
| 2,287,729 | | 6/1942 | Fallert | 229/51 |
| 2,290,971 | | 7/1942 | King | 229/52 |
| 2,487,293 | | 11/1949 | Belsinger | 229/15 |
| 2,694,518 | | 11/1954 | Zanck et al. | 229/15 |
| 3,759,373 | | 9/1973 | Werth et al. | 206/65 C |
| 4,078,357 | | 3/1978 | Ida | 53/26 |
| 4,533,052 | | 8/1985 | Fruchey et al. | 206/602 |
| 4,795,028 | | 1/1989 | Wittig et al. | 206/217 |
| 4,819,793 | * | 4/1989 | Willard et al. | 206/541 |
| 5,056,659 | | 10/1991 | Howes et al. | 206/217 |
| 5,299,733 | | 4/1994 | Werth | 229/120.011 |
| 5,372,827 | | 12/1994 | Brauner et al. | 426/106 |
| 5,664,671 | | 9/1997 | Nedblake, Jr. | 206/217 |
| 5,676,244 | | 10/1997 | Green et al. | 206/221 |
| 5,727,679 | | 3/1998 | Newarski | 206/222 |
| 5,765,336 | | 6/1998 | Neagle et al. | 53/201 |
| 5,816,411 | * | 10/1998 | Smith | 206/218 |
| 5,996,316 | | 12/1999 | Kirschner | 53/443 |
| 6,003,287 | | 12/1999 | Ballestrazzi et al. | 53/546 |
| 6,026,952 | | 2/2000 | Brooks | 206/216 |
| 6,058,679 | | 5/2000 | Ziegler et al. | 53/448 |
| 6,123,214 | | 9/2000 | Goebel | 220/23.4 |

* cited by examiner

*Primary Examiner*—Jim Foster
(74) *Attorney, Agent, or Firm*—Woodcock Washburn Kurtz Mackiewicz & Norris LLP

(57) ABSTRACT

A combined food and beverage package including a snack food container and a multi-pack carton of beverage containers is disclosed. The multi-pack carton typically contains at least six or twelve beverage containers, which can be cans or bottles. A packaging material at least partially surrounds both the multi-pack carton and the snack food container, thus holding the multi-pack carton and the snack food container in combination. The combined package can also include an adhesive between the multi-pack carton and the snack food container that holds a face of the multi-pack carton and a face of the snack food container in mutual abutment. To facilitate palletizing the combined packages, the surface areas of the faces can be approximately the same. Apparatus and methods for manufacturing such a combined food and beverage package are also disclosed.

16 Claims, 3 Drawing Sheets

APPARATUS AND METHODS FOR PACKAGING AND DISTRIBUTING COMBINATIONS OF FOODS AND BEVERAGES

FIELD OF THE INVENTION

This invention relates to apparatus and methods for packaging and distributing multi-pack beverage cartons and snack food containers in combination.

BACKGROUND OF THE INVENTION

It is well known that consumers frequently associate certain snack foods and beverages with one another, and that consumers frequently consume snack foods and beverages in combination. For example, consumers might be inclined to eat peanuts when drinking beer, or to eat popcorn when drinking soda. To capitalize on this, the food and beverage industry has attempted to increase sales of both snack foods and beverages by tying sales of certain beverages to sales of snack food products that are often associated with those beverages. For example, the seller of popcorn might offer the popcorn purchaser a "cents-off" coupon that can be redeemed with the purchase of a case of soda, or the seller of peanuts might offer a peanut coupon to the purchaser of a case of beer.

Although this approach provides the beverage purchaser, for example, with an incentive to purchase the snack food, such an approach requires the purchaser to actually retrieve both the beverage and the snack food.

The extra effort required to locate the additional item, and then carry it or place it into the shopping cart is often just enough to discourage the purchaser from making the additional purchase. Even if the snack food item is placed in reasonable proximity to the beverage, the consumer can still be dissuaded from buying both the snack food and the beverage by having to pick up and carry more than one item.

It would be advantageous, therefore, to manufacturers, bottlers, and merchandisers of snack foods and beverages if products and methods existed that entice the consumer to purchase combinations of snack foods and beverages without requiring the consumer to select and carry separate items. Thus, there is a need in the art for apparatus and methods for packaging and distributing multi-pack beverage cartons and snack food containers in combination.

SUMMARY OF THE INVENTION

The present invention satisfies these needs in the art by providing apparatus and methods for packaging and distributing combinations of multi-pack beverage cartons and snack food containers. A combined food and beverage package according to the invention includes a multi-pack carton containing a plurality of beverage containers, and a snack food container. The beverage containers can be cans or bottles, and the multi-pack carton can contain at least six, or preferably twelve, beverage containers.

A packaging material, which can be a transparent, polymeric, packaging material, at least partially surrounds both the multi-pack carton and the snack food container, thus holding the multi-pack carton and the snack food container in combination. The combined package can also include an adhesive between the multi-pack carton and the snack food container that holds a face of the multi-pack carton and a face of the snack food container in mutual abutment. To facilitate palletizing the combined packages, the surface areas of the faces can be approximately the same.

A method of packaging combinations of foods and beverages according to the invention includes providing a multi-pack carton containing a plurality of beverage containers, providing a snack food container, and applying a packaging material that at least partially surrounds both the multi-pack carton and the snack food container to hold the multi-pack carton and the snack food container in combination. An adhesive can be applied between the multi-pack carton and the snack food container to hold the multi-pack carton and the snack food container in mutual abutment.

Apparatus according to the invention for manufacturing a combined food and beverage package can include a conveyance system, a wrap applicator, and a heat source. The conveyance system transports the multi-pack carton and the snack food container in mutual abutment. The wrap applicator at least partially surrounds both the multi-pack carton and the snack food container with a packaging material that holds the multi-pack carton and snack food container in combination by applying a packaging material to both the multi-pack carton and the snack food container while they are in mutual abutment. The heat source shrinks the applied packaging material to hold the multi-pack carton and the snack food container in combination.

The apparatus can also include a first conveyor that transports the multi-pack carton and provides the multi-pack carton to the conveyance system, and a second conveyor that transports the snack food container and provides the snack food container to the conveyance system. The first conveyor and the second conveyor meet at a junction adapted to cause the multi-pack carton and the food container to come into mutual abutment. An adhesive sprayer can be used to apply an adhesive to at least one of the multi-pack carton and the snack food container to hold the multi-pack carton and the snack food container in mutual abutment.

BRIEF DESCRIPTION OF THE DRAWINGS

The foregoing summary as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific methods and instrumentalities disclosed.

DETAILED DESCRIPTION OF PREFERRED EMBODIMENTS

Figure 1:
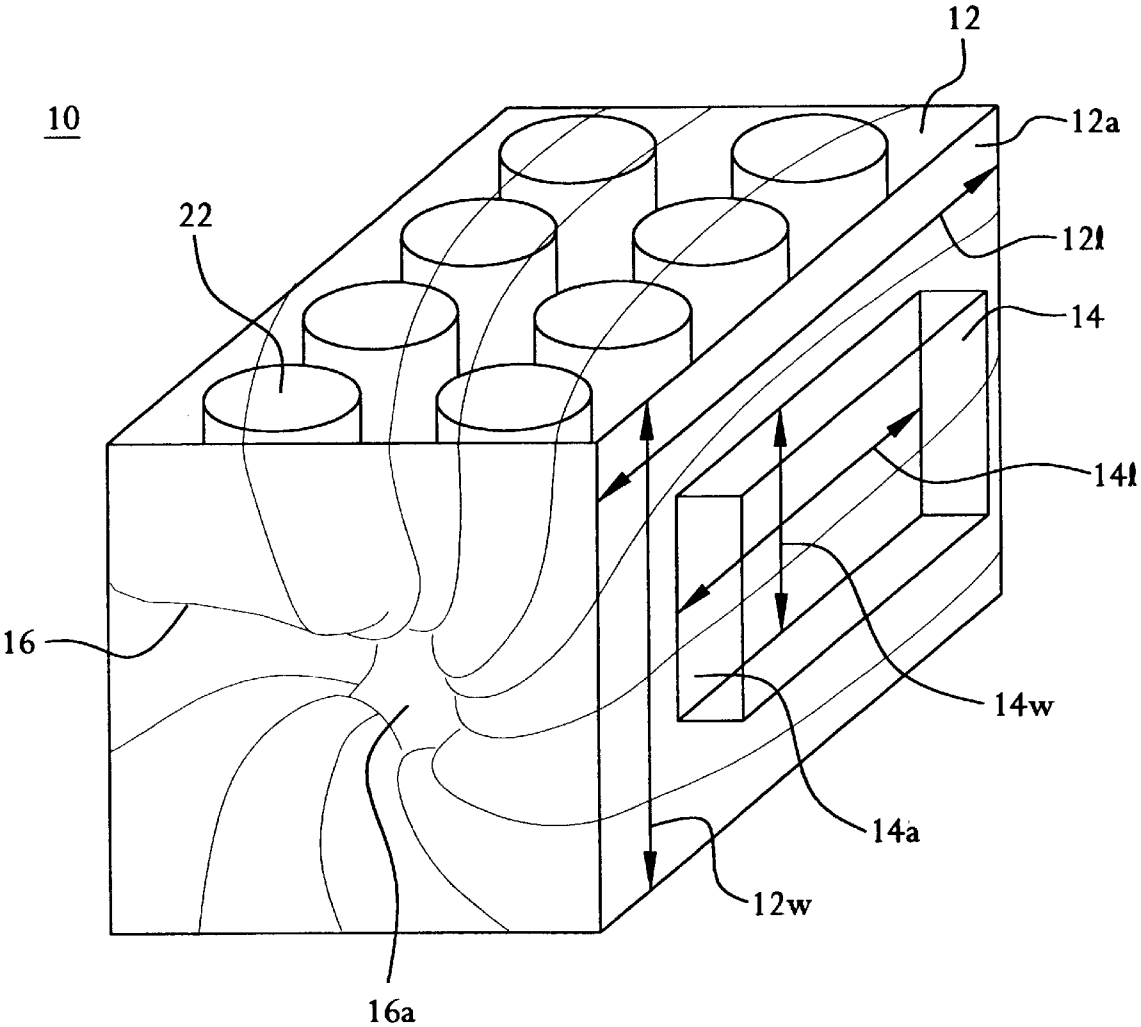
FIG. 1 depicts a preferred embodiment of a combined food and beverage package according to the present invention.

FIG. 1 depicts a preferred embodiment of a combined food and beverage package 10 according to the present invention. As shown, package 10 comprises a multi-pack carton 12 and a snack food container 14. Multi-pack carton 12 contains a plurality of beverage containers 22, which can be, for example, cans, bottles, or the like. Carton 12 can be made of cardboard, or any other suitable material, and can include artwork, trademarks, or other attractive design work to enhance the appeal of the product. Preferably, multi-pack carton 12 contains twelve cans of a beverage such as soda, beer, water, or the like. Snack food container 14 contains a snack food, such as popcorn, peanuts, pretzels, or potato chips, for example. Snack food container 14 can be a bag, box, or canister, for example. Preferably, snack food container 14 is a box.

A packaging material 16 at least partially surrounds both snack food container 14 and multi-pack carton 12, and thus holds multi-pack carton 12 and snack food container 14 in combination against one another. Preferably, packaging material 16 is a sheet of transparent material, such as a sheet of transparent polymeric material commonly known as "shrink-wrap," for example. It is preferred that packaging material 16 is transparent so that the consumer can see both multi-pack carton 12 and snack food container 14, although it may be desirable to use colored or printed packaging material to further enhance the marketing appeal of combined package 10. Combined package 10 can then be offered for sale as an enticement to the consumer to purchase both the snack food and the beverage at the same time.

Figure 2:
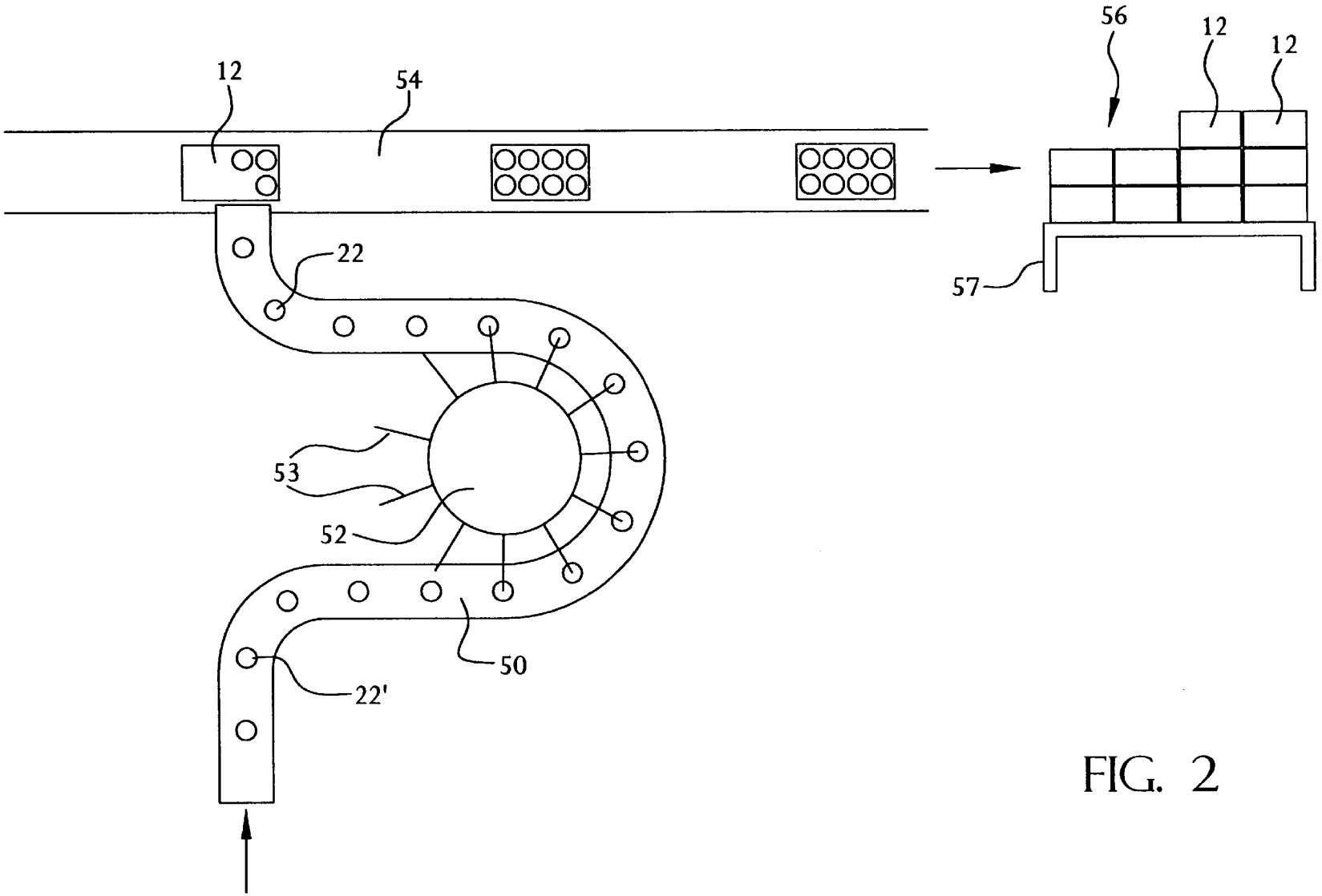
FIG. 2 depicts apparatus for packaging beverages.

Methods and apparatus for manufacturing combined food and beverage containers according to the present invention will now be described. FIG. 2 depicts a top view of apparatus that can be used in a typical bottling operation. As shown, empty beverage containers 22' are transported via a conveyor 50 to be filled as they pass through a filling station 52, which comprises a plurality of filling tubes 53. Once filled, individual beverage containers 22 can be packaged into multi-pack cartons 12. Although any number of beverage containers can be packaged into a multi-pack carton, multi-pack cartons 12 typically contain six, twelve, or twenty-four beverage containers. For purposes of the present invention, it is preferred that multi-pack cartons 12 contain twelve beverage containers 22. Multi-pack cartons 12 can then be transported via a 15 conveyor 54 to be "palletized" (i.e., stacked on pallets 57) at a palletizing area 56.

Figure 3:
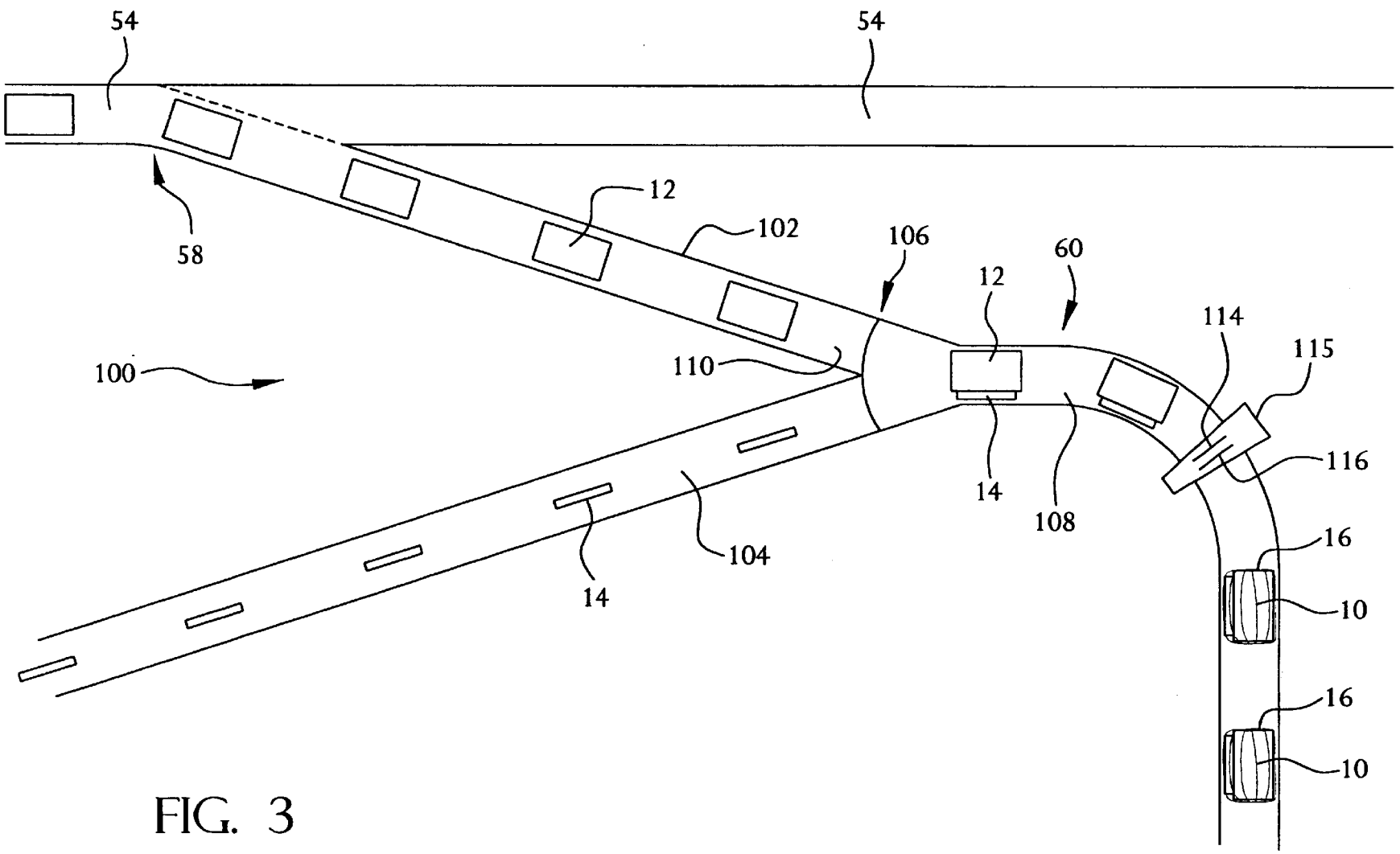
FIG. 3 depicts apparatus according to the present invention for packaging combinations of foods and beverages.

FIG. 3 depicts a preferred embodiment of apparatus 100 for manufacturing combined food and beverage packages according to the present invention. As shown, conveyor 54 can include a switch 58 so that multi-pack cartons 12 can either continue along conveyor 54 to palletizing area 56, or be switched off via a conveyor 102 to a packaging area 60. Alternatively, conveyor 102 can be separate from conveyor 54, with multi-pack cartons 12 being loaded onto conveyor 102 from a remote location (not shown).

In any event, conveyor 102 transports multi-pack cartons at predefined intervals from one another (i.e., there is a predefined distance between successive cartons on conveyor 102). Similarly, a second conveyor 104 transports snack food containers 14 at predefined intervals from one another. Conveyors 102 and 104 meet at a junction 106, where they can continue side-by-side or, more preferably, they can end where a third conveyor 108 begins. Thus, junction 106 can be adapted to cause the multi-pack carton and the food container to come into mutual abutment The intervals between snack food containers 14 should be about the same as the intervals between multi-pack cartons 12 so that multi-pack cartons 12 and snack food containers 14 arrive at junction 106 concurrently. Preferably, multi-pack cartons 12 and snack food containers 14 are oriented on their respective conveyors 102, 104 so that when multi-pack cartons 12 and snack food containers 14 meet at junction 106, multi-pack cartons 12 and snack food containers 14 abut against one another as shown.

Thus, at junction 106, carton 12 and snack food container 14 are positioned relative to one another such that face 12*a* of carton 12 is in abutment with face 14*a* of container 14 (see FIG. 1). To facilitate the packaging process, snack food container 14 is preferably configured such that face 14*a* of snack food container 14 has a length 14l that is approximately the same as a corresponding length 12l of face 12*a* of multi-pack carton 12. More preferably, to facilitate palletizing the combined packages, face 14*a* of snack food container 14 also has a width 14*w* that is approximately the same as a corresponding width 12*w* of face 12*a* of multi-pack carton 12. Thus, in a preferred embodiment, face 12*a* has approximately the same surface area as face 14*a*.

It is desirable that the positions of multi-pack carton 12 and snack food container 14 remain as fixed as possible relative to one another before and during the application of the packaging material. To accomplish this, as shown in FIG. 3, an adhesive sprayer 110 can be used to apply an adhesive either to face 12*a* of carton 12 or face 14*a* of container 14. When carton 12 and container 14 come into contact at junction 106, the two will be adhered together, and thus, carton 12 and container 14 can be maintained in mutual abutment as they continue along conveyor 108.

Conveyor 108 carries multi-pack carton 12 and snack food container 14 into a wrap applicator 114 that places a sleeve or wrap of shrink film around carton 12 and container 14 in combination. Preferably, wrap applicator 114 accomplishes this through a series of stretch rollers that cover the combined package with complete 360 degree coverage, leaving only a "bullseye" opening 16*a* (see FIG. 1) on each end. Heater 116 then heats the shrink film to cause it to shrink into tight, surrounding engagement with carton 12 and container 14.

Preferably, wrap applicator 114 and heater 116 are parts of a shrink wrap machine 115, also known as a "heat shrink tunnel." After it has been shrunk, packaging material 16 contains multi-pack carton 12 and snack food container 14 in combination, with only the bullseye openings at each end remaining after combined package 10 has passed through heat shrink tunnel 115. Packages 10 can continue along conveyor 108, to a location (not shown) where they can be palletized or otherwise unloaded for storage and shipment.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

I claim:

1. A combined food and beverage package comprising:

a multi-pack carton containing a plurality of beverage containers;

a snack food container;

an adhesive between the multi-pack carton and the snack food container that holds a face of the multi-pack carton and a face of the snack food container in mutual abutment; and a packaging material that at least partially surrounds both the multi-pack carton and the snack food container, thus holding the multi-pack carton and the snack food container in combination.

2. The package of claim 1, wherein the packaging material is a sheet of polymeric material.

3. The package of claim 1, wherein the packaging material is transparent.

4. The package of claim 1, wherein the beverage containers are cans or bottles and the multi-pack carton contains at least six beverage containers.

5. The package of claim 4, wherein the multi-pack carton contains at least twelve beverage containers.

6. The package of claim 1, wherein each of the faces has a length, the length of the faces being approximately the same.

7. The package of claim 6, wherein each of the faces has a surface area, the surface areas of the faces being approximately the same.

8. A method of packaging combinations of foods and beverages, comprising:

providing a multi-pack carton containing a plurality of beverage containers;

providing a snack food container; and at least partially surrounding both the multi-pack carton and the snack food container with a packaging material that holds the multi-pack carton and the snack food container in combination, by applying the packaging material to both the multi-pack carton and the snack food container while the multi-pack carton and the snack food container are in mutual abutment.

9. The method of claim 8, wherein providing the multi-pack carton comprises providing a multi-pack carton containing at least six cans or bottles.

10. The method of claim 9, wherein providing the multi-pack carton comprises providing a multi-pack carton containing at least twelve cans or bottles.

11. The method of claim 8, wherein applying the packaging material comprises applying the packaging material while a face of the multi-pack carton is in mutual abutment with a face of the snack food container, each of the faces having a length, the lengths of the faces being approximately the same.

12. The method of claim 8, wherein applying the packaging material comprises applying the packaging material while a face of the multi-pack carton is in mutual abutment with a face of the snack food container, each of the faces having a surface area, the surface areas of the faces being approximately the same.

13. The method of claim 8, further comprising:

applying an adhesive between the multi-pack carton and the snack food container to hold the multi-pack carton and the snack food container in mutual abutment.

14. Apparatus for manufacturing a combined food and beverage package, the apparatus comprising:

a conveyance system that transports a multi-pack carton and a snack food container held in mutual abutment;

a wrap applicator that at least partially surrounds both the multi-pack carton and the snack food container with a packaging material that holds the multi-pack carton and the snack food container in combination, by applying the packaging material to both the multi-pack carton and the snack food container while the multi-pack carton and the snack food container are in mutual abutment; and a heat source that shrinks the applied packaging material to hold the multi-pack carton and the snack food container in combination.

15. Apparatus according to claim 14, further comprising:

a first conveyor that transports the multi-pack carton and provides the multi-pack carton to the conveyance system; and a second conveyor that transports the food container and provides the food container to the conveyance system, wherein the first conveyor and the second conveyor meet at a junction adapted to cause the multi-pack carton and the food container to come into mutual abutment.

16. Apparatus according to claim 14, further comprising:

an adhesive sprayer for applying an adhesive to at least one of the multi-pack carton and the snack food container to hold the multi-pack carton and the snack food container in mutual abutment.

* * * * *